US010553159B2

(12) United States Patent
Wang et al.

(10) Patent No.: US 10,553,159 B2
(45) Date of Patent: Feb. 4, 2020

(54) PIXEL CIRCUIT, DISPLAY PANEL AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Guangxing Wang, Beijing (CN); Bin Zhang, Beijing (CN); Dianzheng Dong, Beijing (CN); Kan Zhang, Beijing (CN); Qiang Zhang, Beijing (CN)

(73) Assignees: BOE TECHNOLOGY GROUP CO., LTD, Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 166 days.

(21) Appl. No.: 15/535,242

(22) PCT Filed: Sep. 30, 2016

(86) PCT No.: PCT/CN2016/101113
§ 371 (c)(1),
(2) Date: Jun. 12, 2017

(87) PCT Pub. No.: WO2017/118125
PCT Pub. Date: Jul. 13, 2017

(65) Prior Publication Data

US 2018/0096654 A1 Apr. 5, 2018

(30) Foreign Application Priority Data

Jan. 5, 2016 (CN) ..... 2016 1 0006055

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2310/0264* (2013.01)

(58) Field of Classification Search
CPC ... G09G 2300/0819; G09G 2300/0842; G09G 2310/0264; G09G 2320/045; G09G 3/323; G09G 3/3258
See application file for complete search history.

(56) References Cited

U.S. PATENT DOCUMENTS 9,898,960 B2 * 2/2018 Yang ..... G09G 3/3233
2006/0262050 A1 11/2006 Ogawa et al.
(Continued)

FOREIGN PATENT DOCUMENTS

CN 1870110 A 11/2006
CN 104036726 A 9/2014
(Continued)

OTHER PUBLICATIONS

International Search Report and Written Opinion dated Dec. 20, 2016; PCT/CN2016/101113.
(Continued)

*Primary Examiner* — Afroza Chowdhury

(57) ABSTRACT

Disclosed are a pixel circuit, a display panel and a display device. The pixel circuit includes driving circuits which are in one-to-one correspondence to data lines, each driving circuit being disposed in a peripheral area of a display panel; compensating circuits which are in one-to-one correspondence to gate lines, each compensating circuit being disposed in a peripheral area of the display panel; and light emitting devices. Each compensating circuit outputs a first reference signal or a second reference signal to the corresponding driving circuit. Each driving circuit drives a corresponding light emitting device to emit light through a signal from the corresponding compensating circuit and a data signal from the corresponding data line. The pixel
(Continued)

circuit of the present disclosure can improve the aperture ratio of a pixel unit.

20 Claims, 4 Drawing Sheets

(56) References Cited

U.S. PATENT DOCUMENTS

| | | | |
|---|---|---|---|
| 2014/0320544 | A1 | 10/2014 | Kim |
| 2016/0253953 | A1 | 9/2016 | Yang et al. |

FOREIGN PATENT DOCUMENTS

| | | | |
|---|---|---|---|
| CN | 104409050 | A | 3/2015 |
| CN | 105609051 | A | 5/2016 |
| KR | 1020130057595 | A | 6/2013 |

OTHER PUBLICATIONS

The First Chinese Office Action dated Aug. 3, 2017; Appln. No. 20160006055.2.

* cited by examiner

PIXEL CIRCUIT, DISPLAY PANEL AND DISPLAY DEVICE

TECHNICAL FIELD

Embodiments of the present disclosure relate to a pixel circuit, a display panel and a display device.

BACKGROUND

With the development of the display technology, organic light emitting diode (OLED) displays have become one of the focuses in the field of the current flat panel display, and more and more organic light emitting diode display panels enter the market. Compared with the traditional thin film transistor liquid crystal display (TFT LCD) panels, the OLED display panels have faster response, higher contrast and wider angle of view.

The traditional organic light emitting diode panels are driven to emit light by means of currents generated by driving transistors (thin film transistor, TFT) in a saturated state. However, upon inputting of the same gray scale voltage, transistors of different threshold voltages generate different driving currents, which causes inconsistency in the driving currents, so that the brightness uniformity among pixels is poor. Therefore, the method of employing a pixel compensation circuit which comprises a compensation circuit and a driving circuit within a pixel is generally adopted to resolve the problem of poor brightness uniformity, namely the influence of the threshold voltage Vth of a driving TFT is eliminated through the pixel compensation circuit. However, the pixel compensation circuit disposed in each pixel leads to increasing the number of the TFT, decreasing the aperture ratio of the pixel and increasing the costs, so that given the condition of the same pixel driving current, the current density of an organic light emitting layer increases, which easily leads to the aging of the material of the light emitting layer and declines the service life of the whole OLED panel.

Therefore, how to improve the aperture ratio of a pixel unit due to occupation by a pixel circuit is a technical problem to be solved for those skilled in the field.

SUMMARY

A purpose of the present disclosure is to improve the aperture ratio of a pixel unit due to occupation by a pixel circuit.

A pixel circuit is provided according to one aspect of the present disclosure, and comprises: a plurality of driving circuits which are in one-to-one correspondence to a plurality of data lines, a plurality of compensating circuits which are in one-to-one correspondence to a plurality of gate lines, and a plurality of light emitting devices, wherein each driving circuit is disposed in a peripheral area of a display panel where one terminal of a corresponding data line is directed to, and each compensating circuit is disposed in a peripheral area of a display panel where one terminal of a corresponding gate line is directed to.

Optionally, each compensation circuit is provided with a first input terminal configured to receive a first reference signal, a second input terminal configured to receive a second reference signal, a first control terminal configured to receive a first control signal, a second control terminal configured to receive a second control signal and an output terminal connected to a first input terminal of a corresponding driving circuit of the driving circuits which corresponds to the compensating circuit. Under a control of the first control signal and the second control signal, each compensation circuit outputs the first reference signal or the second reference signal to the first input terminal of the corresponding driving circuit.

Optionally, each driving circuit is provided with the first input terminal connected to the output terminal of a corresponding compensating circuit of the compensating circuits which corresponds to the driving circuit, and a second input terminal configured to receive a data signal from a corresponding data line, a third control terminal configured to receive a third control signal, a fourth control terminal configured to receive a fourth control signal and an output terminal connected to an input terminal of a corresponding light emitting device of the light emitting devices which corresponds to the driving circuit. Under a control of the third control signal and the fourth control signal, each driving circuit drives the corresponding light emitting device to emit light through a signal from the corresponding compensating circuit and the data signal from the corresponding data line.

Optionally, an output terminal of each light emitting device is connected to a third reference signal terminal.

Optionally, each compensating circuit outputs a gate scanning signal to the corresponding gate line.

Optionally, each compensation circuit comprises a first switching transistor, a second switching transistor, a third switching transistor and a fourth switching transistor. The first switching transistor is provided with a gate electrode configured to receive the first control signal, a source electrode configured to receive the first reference signal and a drain electrode connected to the first input terminal of the driving circuit which corresponds to the compensating circuit. The second switching transistor is provided with a gate electrode configured to receive the second control signal, a source electrode configured to receive the first reference signal and a drain electrode connected to the first input terminal of the driving circuit which corresponds to the compensating circuit. The third switching transistor is provided with a gate electrode configured to receive the first control signal, a source electrode connected to a drain electrode of the fourth switching transistor and a drain electrode connected to the first input terminal of the driving circuit which corresponds to the compensating circuit. The fourth switching transistor is provided with a gate electrode configured to receive the second control signal and a source electrode the second reference signal.

Optionally, each driving circuit comprises a write sub-circuit, a light-emitting control sub-circuit and a driving sub-circuit.

The write sub-circuit is provided with a first control terminal configured to receive the third control signal, a second control terminal configured to receive the fourth control signal, a first input terminal configured to receive a data signal from a corresponding data line, an output terminal connected to a first node and a second input terminal connected to a second node. Under a control of the third control signal and the fourth control signal, the write sub-circuit is configured to write the data signal from the corresponding data line to the first node, and implement threshold voltage compensation to the first node.

The driving sub-circuit is provided with a control terminal connected to the first node, an input terminal connected to the output terminal of the compensating circuit which corresponds to the driving circuit and an output terminal connected to the second node. Under a control of the first node, the driving sub-circuit is configured to output a signal from the corresponding compensating circuit to the second node.

The light-emitting control sub-circuit is provided with a control terminal configured to receive the third control signal, an input terminal connected to the second node and an output terminal connected to an input terminal of the light emitting device which corresponds to the driving circuit. Under a control of the third control signal, the light-emitting control sub-circuit is configured to output a signal of the second node to the input terminal of the corresponding light emitting device.

Optionally, the write sub-circuit comprises a data writing sub-circuit and a compensating sub-circuit.

The data writing sub-circuit is provided with a control terminal configured to receive the third control signal, an input terminal configured to receive a data signal from the corresponding data line and an output terminal connected to the first node. Under the control of the third control signal, the data writing sub-circuit writes the data signal of the corresponding data line to the first node.

The compensating sub-circuit is provided with a control terminal configured to receive the fourth control signal, an input terminal connected to the second node and an output terminal connected to the first node. Under a control of the fourth control signal, the compensating sub-circuit is configured to electrically conduct the first node and the second node and implement threshold voltage compensation to the first node.

Optionally, the data writing sub-circuit comprises a fifth switching transistor and a capacitor. A gate electrode of the fifth switching transistor receives the third control signal, a source electrode of the fifth switching transistor receives the data signal of the corresponding data line, and a drain electrode of the fifth switching transistor is connected to one terminal of the capacitor. The other terminal of the capacitor is connected to the first node.

Optionally, the compensating sub-circuit comprises a sixth switching transistor. A gate electrode of the sixth switching transistor receives the fourth control signal, a source electrode of the sixth switching transistor is connected to the second node, and a drain electrode of the sixth switching transistor is connected to the first node.

Optionally, the driving sub-circuit comprises a seventh switching transistor. A gate electrode of the seventh switching transistor is connected to the first node, a source electrode of the seventh switching transistor is connected to an output terminal of the compensating circuit which corresponds to the driving circuit, and a drain electrode of the seventh switching transistor is connected to the second node.

Optionally, the light-emitting control sub-circuit comprises an eighth switching transistor. A gate electrode of the eighth switching transistor receives the third control signal, a source electrode of the eighth switching transistor is connected to the second node, and a drain electrode of the eighth switching transistor is connected to the input terminal of the light emitting device which corresponds to the driving circuit.

A display panel is further provided according to another aspect of the present disclosure, and comprises the above mentioned pixel circuit, a gate electrode driver and a source electrode driver.

The gate electrode driver provides a first control signal and a second control signal to a first control terminal and a second control terminal of each compensating circuit of the pixel circuit respectively. Under a control of the first control signal and the second control signal, each compensating circuit outputs a first reference signal or a second reference signal to a first input terminal of the driving circuit which corresponds to the compensating circuit of the pixel circuit.

The source electrode driver provides a data signal to each driving circuit of the pixel circuit. And each driving circuit drives a light emitting device corresponding to the driving circuit to emit light through a signal from the compensating circuit which corresponds to the driving circuit and the data signal from the source electrode driver.

Optionally, the gate electrode driver outputs a gate scanning signal to a gate line which corresponds to the compensating circuit through the compensating circuit.

A display device is further provided according to another aspect of the present disclosure, and comprises the above mentioned display panel.

Embodiments of the present disclosure provide a pixel circuit, a display panel and a display device. The pixel circuit comprises driving circuits which are in one-to-one correspondence to data lines, compensating circuits which are in one-to-one correspondence to gate lines and light emitting devices, wherein, each driving circuit is disposed in a peripheral area of a display panel where one terminal of a corresponding data line is directed to, and each compensating circuit is disposed in a peripheral area of a display panel where one terminal of a corresponding gate line is directed to, under a control of the first control signal and the second control signal, each compensation circuit outputs the first reference signal or the second reference signal to the first input terminal of the corresponding driving circuit, and under a control of the third control signal and the fourth control signal, each driving circuit drives a corresponding light emitting device to emit light through a signal from the corresponding compensating circuit and the data signal from the corresponding data line. In this way, the pixel circuit can drive the corresponding light emitting device to emit light normally through the compensating circuit and the driving circuit. And each compensating circuit and each driving circuit of the pixel circuit are respectively disposed in the peripheral area of the display panel where one terminal of the corresponding data line is directed to and the peripheral area of the display panel where one terminal of a corresponding gate line is directed to, which can improve the aperture ratio of the pixel unit compared with a mode which the pixel circuit is disposed in the pixel unit. In addition, in the pixel circuit provided by embodiments of the present disclosure, one compensating circuit corresponds to one gate line and one data line corresponds to one driving circuit, which can simplify the structure of the pixel circuit compared with a mode which the compensating circuit and the driving circuit are disposed within each pixel unit, so as to reduce the production costs.

DETAILED DESCRIPTION

A pixel circuit, a display panel and a display device provided by embodiments of the present disclosure will be described in detail below in conjunction with the accompanying drawings.

Figure 6:
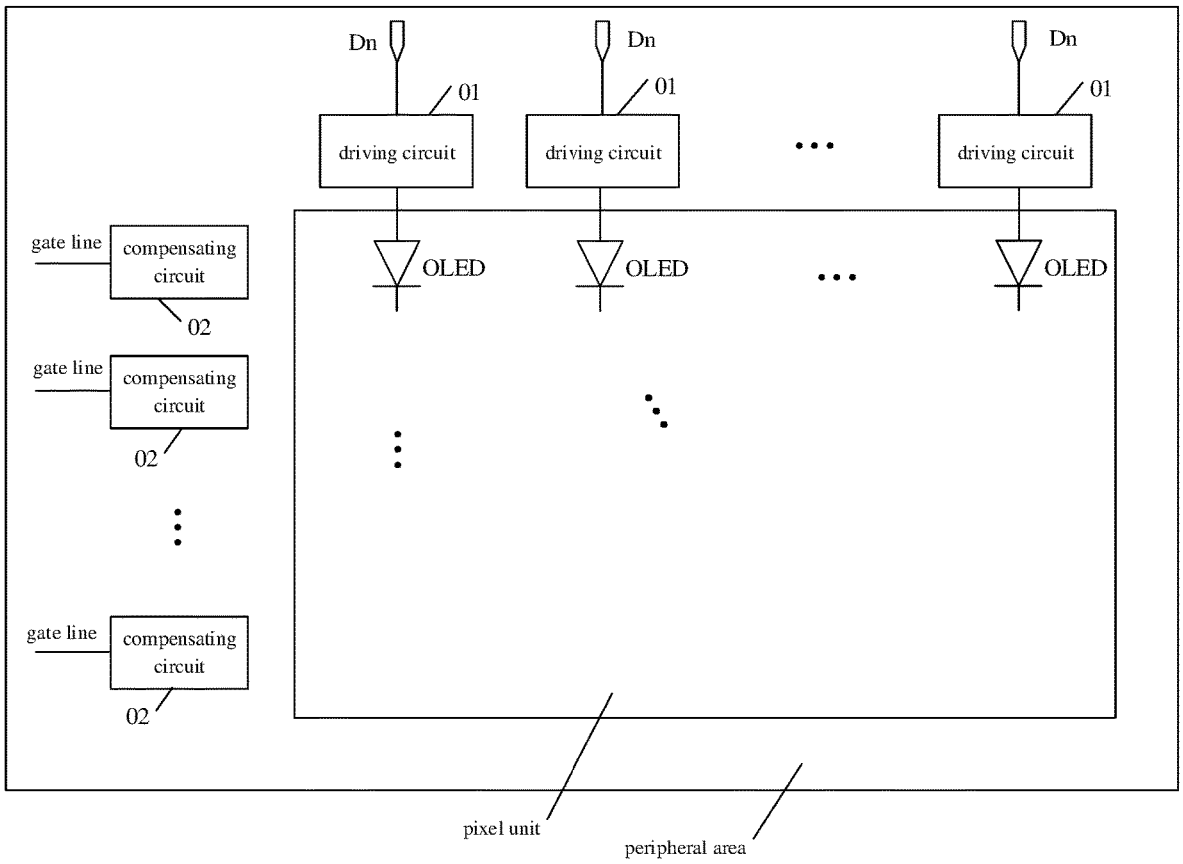
FIG. 6 is a schematic view of a structure of a pixel circuit provided by an embodiment of the present disclosure.

FIG. 6 shows a schematic view of a structure of a pixel circuit provided by an embodiment of the present disclosure, as shown in FIG. 6, a pixel circuit provided by an embodiment of the present disclosure comprises driving circuits 01 which are in one-to-one correspondence to data lines Dn, compensating circuits 02 which are in one-to-one correspondence to gate lines, and light emitting devices OLED; each of the driving circuits 01 is disposed in a peripheral area of a display panel where one terminal of a corresponding data line Dn is directed to, and each compensating circuit 02 is disposed in a peripheral area of a display panel where one terminal of a corresponding gate line is directed to.

Figure 1:
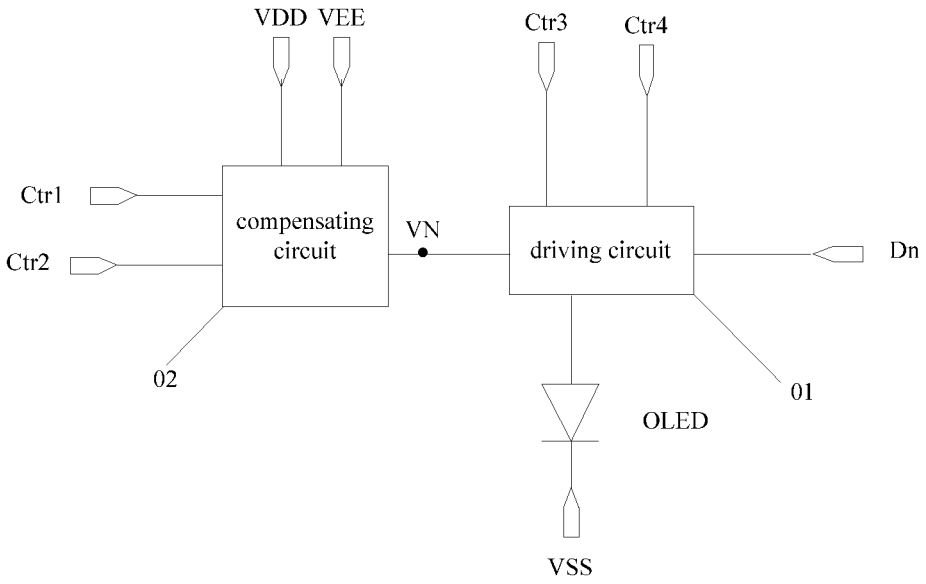
FIG. 1 is a schematic view of a part structure of a pixel circuit provided by an embodiment of the present disclosure.

FIG. 1 shows a driving circuit 01 corresponding to a data lines Dn, a compensating circuit 02 corresponding to the driving circuit 01, and a light emitting device OLED of the pixel circuit provided in an embodiment of the present disclosure.

A first input terminal of the compensating circuit 02 receives a first reference signal VDD, a second input terminal of the compensating circuit 02 receives a second reference signal VEE, a first control terminal of the compensating circuit 02 receives a first control signal Ctr1, a second control terminal of the compensating circuit 02 receives a second control signal Ctr2, and an output terminal of the compensating circuit 02 is connected to a first input terminal VN of the corresponding driving circuit 01. Under a control of the first control signal Ctr1 and the second control signal Ctr2, the compensating circuit 02 outputs the first reference signal VDD or the second reference signal VEE to the first input terminal VN of the driving circuit 01.

A second input terminal of the driving circuit 01 receives a data signal from a corresponding data line Dn, a third control terminal control of the driving circuit 01 receives a third control signal Ctr3, a fourth control terminal of the driving circuit 01 receives a fourth control signal Ctr4, and an output terminal of the driving circuit 01 is connected to an input terminal of the corresponding light emitting device OLED. Under a control of the third control signal Ctr3 and the fourth control signal Ctr4, the driving circuit 01 drives the corresponding light emitting device OLED to emit light through a signal from the corresponding compensating circuit 02 and the data signal from the corresponding data line Dn. An output terminal of the light emitting device OLED is connected to a third reference signal terminal VSS.

In the above mentioned pixel circuit provided by an embodiment of the present disclosure, the light emitting device may be driven to emit light normally through the compensating circuit and the driving circuit. At the same time, in the pixel circuit, each driving circuit and each compensating circuit are respectively disposed in the peripheral area of the display panel where one terminal of the corresponding data line is directed to and in the peripheral area of the display panel where one terminal of the corresponding gate line is directed to, which can improve the aperture ratio of the pixel unit compared with a mode which the pixel circuit is disposed in the pixel unit. In addition, in the pixel circuit provided by an embodiment of the present disclosure, one compensating circuit corresponds to one gate line and one data line corresponds to one driving circuit, which can simplify the structure of the pixel circuit compared with the mode which the compensating circuit and the driving circuit are disposed in each pixel unit, so that the production costs can be reduced.

In the pixel circuit provided by an embodiment of the present disclosure, each compensating circuit may also outputs a gate scanning signal to the corresponding gate line. Because each compensating circuit corresponds to one gate line, so the compensating circuit can outputs the gate scanning signal outputted by a gate electrode driver to the corresponding gate line, so as to ensure that the display panel achieves progressive scanning.

Figure 2:
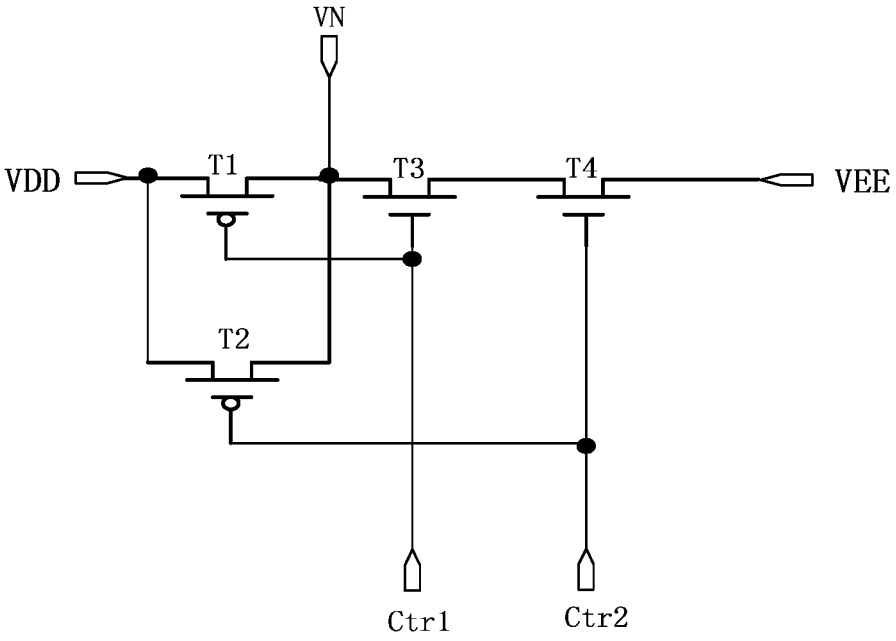
FIG. 2 is a schematic view of a circuit structure of a compensating circuit of a pixel circuit provided by an embodiment of the present disclosure.

In an embodiment, as illustrated in FIG. 2, the compensating circuit may comprise a first switching transistor T1, a second switching transistor T2, a third switching transistor T3 and a fourth switching transistor T4. A gate electrode of the first switching transistor T1 receives the first control signal Ctr1, a source electrode of the first switching transistor T1 receives the first reference signal VDD, and a drain electrode of the first switching transistor T1 is connected to the first input terminal VN of the driving circuit which corresponds to the compensating circuit. A gate electrode of the second switching transistor T2 receives the second control signal Ctr2, a source electrode of the second switching transistor T2 receives the first reference signal VDD, and a drain electrode of the second switching transistor T2 is connected to the first input terminal VN of the driving circuit which corresponds to the compensating circuit. A gate electrode of the third switching transistor T3 receives the first control signal Ctr1, a source electrode of the third switching transistor T3 is connected to a drain electrode of the fourth switching transistor T4, and a drain electrode of the third switching transistor T3 is connected to the first input terminal VN of the driving circuit which corresponds to the compensating circuit. A gate electrode of the fourth switching transistor T4 receives the second control signal Ctr2 and a source electrode of the fourth switching transistor T4 receives the second reference signal VEE.

In an embodiment, the first switching transistor T1 and the second switching transistor T2 are P-type transistors, and the third switching transistor T3 and the fourth switching transistor T4 are N-type transistors.

In the case that the first control signal Ctr1 and the second control signal Ctr2 are at high levels, the first switching transistor T1 and the second switching transistor T2 are switched off, and the third switching transistor T3 and the fourth switching transistor T4 are switched on. The third switching transistor T3 and the conductive fourth switching transistor T4 that are switched on output the second reference signal VEE to the first input terminal VN of the driving circuit.

In the case that the first control signal Ctr1 and the second control signal Ctr2 are at low levels, the first switching transistor T1 and the second switching transistor T2 are switched on, and the third switching transistor T3 and the fourth switching transistor T4 are switched off. The first switching transistor T1 and the conductive second switching transistor T2 that are switched on output the first reference signal VDD to the first input terminal VN of the driving circuit.

In the case that the first control signal Ctr1 is at a low level and the second control signal Ctr2 is at a high level, the first switching transistor T1 and the fourth switching transistor T4 are switched on, and the second switching transistor T2 and the third switching transistor T3 are switched off. The switched-on first switching transistor T1 outputs the first reference signal VDD to the first input terminal VN of the driving circuit.

In the case that the first control signal Ctr1 is at a high level and the second control signal Ctr2 is at a low level, the second switching transistor T2 and the third switching transistor T3 are switched on, and the first switching transistor T1 and the fourth switching transistor T4 are switched off. The switched-on the second switching transistor T2 outputs the first reference signal VDD to the first input terminal VN of the driving circuit.

Figure 3:
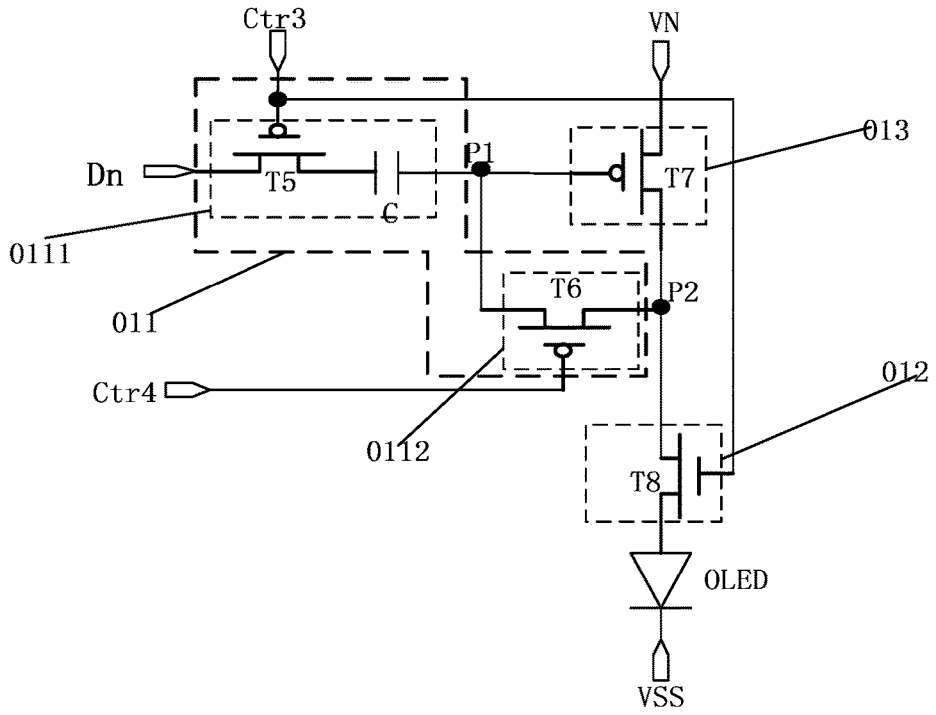
FIG. 3 is a schematic view of a circuit structure of a driving circuit of a pixel circuit provided by an embodiment of the present disclosure.

In an embodiment, as illustrated in FIG. 3, the driving circuit may comprise a writing sub-circuit 011, a light-emitting control sub-circuit 012 and a driving sub-circuit 013.

A first control terminal of the writing sub-circuit 011 receives the third control signal Ctr3, a second control terminal of the writing sub-circuit 011 receives the fourth control signal Ctr4, a first input terminal of the writing sub-circuit 011 receives a data signal over the corresponding data line Dn, an output terminal of the writing sub-circuit 011 is connected to a first node P1, and a second input terminal of the writing sub-circuit 011 is connected to a second node P2. Under a control of the third control signal Ctr3 and the fourth control signal Ctr4, the writing sub-circuit 011 writes the data signal over the corresponding data line Dn to the first node P1, and implements threshold voltage compensation to the first node P1.

A control terminal of the driving sub-pixel 013 is connected to the first node P1, an input terminal of the driving sub-pixel 013 is connected to the output terminal of the compensating circuit which corresponds to the driving circuit, and an output terminal of the driving sub-pixel 013 is connected to the second node P2. Under a control of the first node P1, the driving sub-circuit 013 outputs a signal from the corresponding compensating circuit to the second node P2.

A control terminal of the light-emitting control sub-circuit 012 receives the third control signal Ctr3, an input terminal of the light-emitting control sub-circuit 012 is connected to the second node P2, and an output terminal of the light-emitting control sub-circuit 012 is connected to an input terminal of the light emitting device OLED which corresponds to the driving circuit. Under a control of the third control signal Ctr3, the light-emitting control sub-circuit 012 outputs a signal of the second node P2 to the input terminal of the corresponding light emitting device OLED.

In the above mentioned pixel circuit, the driving circuit may comprise the writing sub-circuit, the light-emitting control sub-circuit and the driving sub-circuit. Under the control of the third control signal and the fourth control signal, the writing sub-circuit can write the data signal of the corresponding data line to the first node and implements threshold voltage compensation to the first node. Under the control of the first node, the driving sub-circuit outputs the signal inputted by the compensating circuit which corresponds to the driving circuit to the second node. Under the control of the third control signal, the light-emitting control sub-circuit outputs the signal of the second node to the input terminal of the light emitting device which corresponds to the driving circuit, so as to drive the light emitting device to emit light. Because the threshold voltage is compensated for the control terminal (namely, the first node) of the driving sub-circuit, the influence of the threshold voltage variation on the luminance of the light emitting device can be eliminated so as to improve the uniformity of the luminance of the light emitting device.

As illustrated in FIG. 3, the writing sub-circuit 011 may comprise a data writing sub-circuit 0111 and a compensating sub-circuit 0112. A control terminal of the data writing sub-circuit 0111 receives the third control signal Ctr3, an input terminal of the data writing sub-circuit 0111 receives a data signal over the corresponding data line Dn, and an output terminal of the data writing sub-circuit 0111 is connected to the first node P1. Under the control of the third control signal Ctr3, the data writing sub-circuit 0111 writes the data signal of the corresponding data line Dn to the first node P1. A control terminal of the compensating sub-circuit 0112 receives the fourth control signal Ctr4, an input terminal of the compensating sub-circuit 0112 is connected to the second node P2, and an output terminal of the compensating sub-circuit 0112 is connected to the first node P1. Under the control of the fourth control signal Ctr4, the compensating sub-circuit 0112 electrically conducts the first node P1 and the second node P2, and implements threshold voltage compensation to the first node P1.

In the above mentioned pixel circuit, the writing sub-circuit may comprise the data writing sub-circuit and the compensating sub-circuit. Under the control of the third control signal, the data writing sub-circuit writes the data signal of the corresponding data line to the first node so as to drive the corresponding light emitting device to emit light. Under the control of the fourth control signal, the compensating sub-circuit can electrically conduct the first node and the second node, and implements threshold voltage compensation to the first node so as to eliminate the influence of the threshold voltage variation on the luminance of the light emitting device and improve the uniformity of the luminance of the light emitting device.

As illustrated in FIG. 3, the data writing sub-circuit 0111 may comprise a fifth switching transistor T5 and a capacitor C. A gate electrode of the fifth switching transistor T5 receives the third control signal Ctr3, a source electrode of the fifth switching transistor T5 receives the data signal of the corresponding data line Dn and a drain electrode of fifth switching transistor T5 is connected to one terminal of the capacitor C. The other terminal of the capacitor C is connected to the first node P1. The fifth switching transistor T5 can be switched on under the control of the third control signal Ctr3 so as to output the data signal of the corresponding data line Dn to one terminal of the capacitor C.

As illustrated in FIG. 3, the compensating sub-circuit 0112 may comprise a sixth switching transistor T6. A gate electrode of the sixth switching transistor T6 receives the fourth control signal Ctr4, a source electrode of the sixth switching transistor T6 is connected to the second node P2, and a drain electrode of the sixth switching transistor T6 is connected to the first node P1. The sixth switching transistor T6 can be switched on under the control of the fourth control signal Ctr4, so as to electrically conduct the first node P1 and the second node P2 to achieve the threshold voltage compensation to the first node P1.

As illustrated in FIG. 3, the driving sub-circuit 013 may comprise a seventh switching transistor T7. A gate electrode of the seventh switching transistor T7 is connected to the first node P1, a source electrode of the seventh switching transistor T7 is connected to the output terminal (namely, the first input terminal VN of the driving circuit) of the compensating circuit which corresponds to the driving circuit, and a drain electrode of the seventh switching transistor T7 is connected to the second node P2. Under the control of the first node P1, the seventh switching transistor T7 can output the signal from the compensating circuit, which corresponds to the driving circuit, to the second node P2, namely, output a power signal, which is used for driving the light emitting device OLED to emit light, to the second node P2.

As illustrated in FIG. 3, the light-emitting control subcircuit 012 may comprise an eighth switching transistor T8. A gate electrode of the eighth switching transistor T8 receives the third control signal Ctr3, a source electrode of the eighth switching transistor T8 is connected to the second node P2, and a drain electrode of the eighth switching transistor T8 is connected to the input terminal of the light emitting device OLED which corresponds to the driving circuit. The eighth switching transistor T8 can be switched on under the control of the third control signal Ctr3, which can electrically conduct the second node P2 and the input terminal of the light emitting device OLED, and then the signal, which is used for driving the light emitting device OLED to emit light, is inputted to the input terminal of the light emitting device OLED, so as to drive the light emitting device OLED to emit light.

It should be noted that the switching transistor mentioned in the embodiments of the present disclosure may be a thin film transistor, and may also be a metal oxide semiconductor field effect transistor (MOS FET), which will not be limited herein. In different embodiments, the source electrode of the transistors and the drain electrode of the transistors may be interchanged without distinction.

Figure 4:
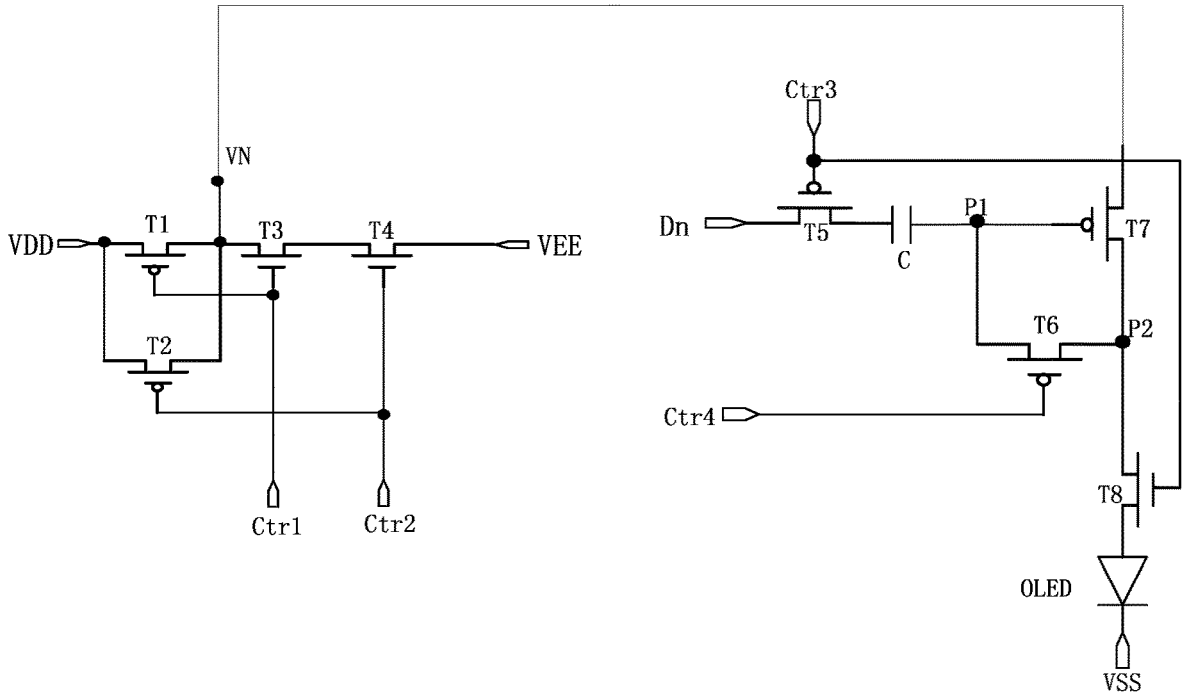
FIG. 4 is a schematic view of a part structure of a pixel circuit provided by an embodiment of the present disclosure.
Figure 5:
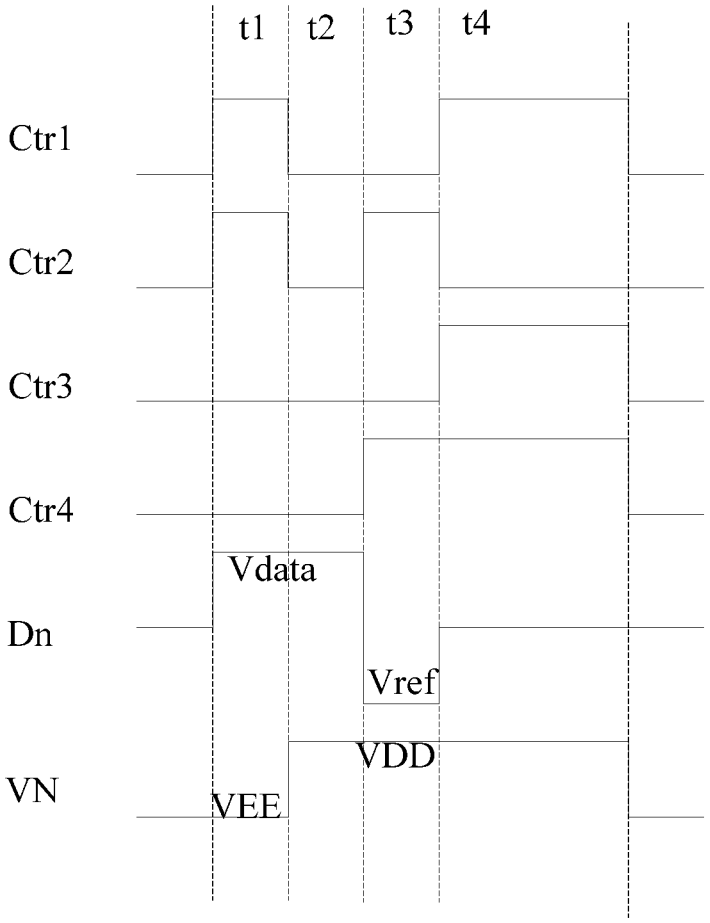
FIG. 5 is a schematic view of an input-output timing sequence of a pixel circuit provided by an embodiment of the present disclosure.

A working process of the pixel circuit provided by an embodiment of the present disclosure will be described in detail below in conjunction with FIG. 4 and FIG. 5. FIG. 4 shows a part structure of a pixel circuit according to an embodiment of the present disclosure, and FIG. 5 shows an input and output timing sequence of the pixel circuit comprising four stages from t1 to t4 as illustrated in FIG. 4. In the following description, "1" represents a high level signal, and "0" represents a low level signal.

The t1 stage is a reset stage.

In the t1 stage, Ctr1=1, Ctr2=1, Ctr3=0, Ctr4=0, and Dn=Vdata. Because Ctr1=1 and Ctr2=1, the first switching transistor T1 and the second switching transistor T2 are switched off, and the third switching transistor T3 and the fourth switching transistor T4 are switched on. The switched-on third switching transistor T3 and the switched-on fourth switching transistor T4 output the second reference signal VEE to the first input terminal VN of the driving circuit, namely to the source electrode of the seventh switching transistor T7. Because Ctr3=0 and Ctr4=0, the fifth switching transistor T5 and the sixth switching transistor T6 are switched on. The switched-on fifth switching transistor T5 outputs the data signal Vdata from the data line Dn to one terminal of the capacitor C. The switched-on sixth switching transistor T6 electrically conducts the first node P1 and the second node P2, namely electrically conducts the gate electrode and the drain electrode of the seventh switching transistor T7. At this time, the source electrode of the seventh switching transistor T7 receives the second reference signal VEE, so that the potential of the first node P1 and the second node P2, namely the gate electrode and the drain electrode of the seventh switching transistor T7, both are VEE+Vth, and here Vth is a threshold voltage of the seventh switching transistor T7. At this time, the voltage difference across the two terminals of the capacitor C is Vdata-VEE-Vth.

The t2 stage is a compensation stage.

In the t2 stage, Ctr1=0, Ctr2=0, Ctr3=0, Ctr4=0, and Dn=Vdata. Because Ctr1=0 and Ctr2=0, the first switching transistor T1 and the second switching transistor T2 are switched on, and the third switching transistor T3 and the fourth switching transistor T4 are switched off. The switched-on first switching transistor T1 and the switched-on second switching transistor T2 output the first reference signal VDD to the first input terminal VN of the driving circuit, namely to the source electrode of the seventh switching transistor T7. Because Ctr3=0 and Ctr4=0, the fifth switching transistor T5 and the sixth switching transistor T6 are switched on. The switched-on fifth switching transistor T5 outputs the data signal Vdata from the data line Dn to one terminal of the capacitor C. And the switched-on sixth switching transistor T6 electrically conducts the first node P1 and the second node P2, namely electrically conducts the gate electrode and the drain electrode of the seventh switching transistor T7. At this time, the source electrode of the seventh switching transistor T7 receives the first reference signal VDD, so that the first reference signal VDD and the signal from the data line Dn respectively charge the gate electrode of the seventh switching transistor T7 through the seventh switching transistor T7 and the fifth switching transistor T5. In the case that the gate electrode of the seventh switching transistor T7 is charged to VDD+Vth, the seventh switching transistor T7 is switched off and stops charging. At this time, the voltage of the drain electrode of the seventh switching transistor T7 also is VDD+Vth, and the voltage difference across the two terminals of the capacitor C is Vdata−VDD−Vth.

The t3 is a data writing stage.

In the t3 stage, Ctr1=0, Ctr2=1, Ctr3=0, Ctr4=1, and Dn=Vref. Because Ctr1=0 and Ctr2=1, the first switching transistor T1 and the fourth switching transistor T4 are switched on, and the second switching transistor T2 and the third switching transistor T3 are switched off. The switched-on first switching transistor T1 outputs the first reference signal VDD to the first input terminal VN of the driving circuit, namely to the source electrode of the seventh switching transistor T7. Because Ctr3=0 and Ctr4=1, the fifth switching transistor T5 is switched on. The switched-on fifth switching transistor T5 outputs the data signal Vref from the data line Dn to one terminal of the capacitor C, so that the potential of the other terminal (namely the first node P1) of the capacitor C changes to Vref−Vdata+VDD+Vth, and accordingly, the potential of the gate electrode of the seventh switching transistor T7 also is Vref−Vdata+VDD+Vth, however the source electrode of the seventh switching transistor T7 remains VDD.

The t4 stage is a light-emitting stage.

In the t4 stage, Ctr1=1, Ctr2=0, Ctr3=1, Ctr4=1, and Dn=0. Because Ctr1=1, Ctr2=0, the second switching transistor T2 and the third switching transistor T3 are switched on, and the first switching transistor T1 and the fourth switching transistor T4 are switched off. The switched-on the second switching transistor T2 outputs the first reference signal VDD to the first input terminal VN of the driving circuit, namely to the source electrode of the seventh switching transistor T7. Because Ctr3=1 and Ctr4=1, the eighth switching transistor T8 is switched on. The conductive eighth switching transistor T8 electrically conducts the second node P2 and the input terminal of the light emitting device OLED, so as to drive the light emitting device to emit light normally.

In t4 stage, the voltage of the gate electrode of the seventh switching transistor T7 is Vref−Vdata+VDD+Vth, the voltage of the source electrode of the seventh switching transistor T7 is VDD, the driving current for driving the light emitting device OLED to emit light is $I=K(Vgs-Vth)^2=K$ $(Vref-Vdata+VDD+Vth-VDD-Vth)^2=K(Vref-Vdata)^2$, where K is a constant associated with the process parameters and geometry dimensions of the seventh switching transistor T7, and Vgs is the voltage difference between the gate electrode and the source electrode of the seventh switching transistor T7. The turn-on current of the light emitting device is independent of the input voltage signal VDD of the reference signal terminal and the threshold voltage of the seventh switching transistor T7, so as to eliminate the influence of the attenuation of the voltage signal provided to the seventh switching transistor T7 and the threshold voltage Vth variation on the luminance of the light emitting device.

An embodiment of the present disclosure further provides a display panel, which may comprise a gate electrode driver, a source electrode driver and a pixel circuit according to at least an embodiment of the present disclosure, the gate electrode driver provides a first control signal and a second control signal to a first control terminal and a second control terminal of each compensating circuit of the pixel circuit respectively, and under a control of the first control signal and the second control signal, each compensating circuit outputs a first reference signal or a second reference signal to a first input terminal of the driving circuit which corresponds to the compensating circuit in the pixel circuit, and a source electrode driver provides a data signal to each driving circuit of the pixel circuit, each driving circuit drives a light emitting device to emit light through a signal from the corresponding compensating circuit and the data signal from the source electrode driver.

In the above mentioned display panel, the gate electrode driver provides the first control signal and the second control signal to the pixel circuit, the source electrode driver provides the data signal to the pixel circuit, so that under the control of the first control signal and the second control signal, the pixel circuit can drive the light emitting device to emit light through the data signal from the source electrode driver, so as to achieve the display function of the display panel.

In an embodiment, in the display panel, the gate electrode driver outputs a gate scanning signal, through each compensating circuit, to a gate line to which each compensating circuit corresponds. In an embodiment, one compensating circuit may correspond to one gate line, so the gate scanning signal outputted by the gate electrode driver may be outputted to the corresponding gate line, so as to ensure that the display panel achieves progressive scanning. At the same time, compared with the mode which the compensating circuit is disposed within each pixel unit, the mode which one compensating circuit corresponds to one gate line can simplify the structure of the pixel circuit, so as to reduce the production costs. Similarly, one data line may correspond to one driving circuit, which can simplify the structure of the pixel circuit compared with the mode which the driving circuit is disposed within each pixel unit, so as to reduce the production costs.

An embodiment of the present disclosure further provides a display device, which may comprise the display panel according to an embodiment of the present disclosure. The display device may be applied to a mobile photo, a tablet computer, a television, a monitor, a notebook computer, a digital photo frame, a GPS, or any product or components having any display function.

Embodiments of the present disclosure provide a pixel circuit, a display panel and a display device. The pixel circuit comprises driving circuits which are in one-to-one correspondence to data lines, compensating circuits which are in one-to-one correspondence to gate lines and light emitting devices; each driving circuit is disposed in a peripheral area of a display panel where one terminal of a corresponding data line is directed to, and each compensating circuit is disposed in a peripheral area of a display panel where one terminal of a corresponding gate line is directed to, under a control of the first control signal and the second control signal, each compensation circuit outputs the first reference signal or the second reference signal to the first input terminal of the corresponding driving circuit, and under a control of the third control signal and the fourth control signal, each driving circuit drives a corresponding light emitting device to emit light through a signal from the corresponding compensating circuit and the data signal from the corresponding data line. In this way, the pixel circuit can drive the corresponding light emitting device to emit light normally through the compensating circuit and the driving circuit. Each compensating circuit and each driving circuit of the pixel circuit are respectively disposed in a peripheral area of a display panel where one terminal of a corresponding data line is directed to and a peripheral area of a display panel where one terminal of a corresponding gate line is directed to, which can improve the aperture ratio of the pixel unit compared with a mode which the pixel circuit is disposed within the pixel unit. In addition, in the pixel circuit provided by at least an embodiment of the present disclosure, one compensating circuit corresponds to one gate line and one data line corresponds to one driving circuit, which can simplify the structure of the pixel circuit compared with a mode which the compensating circuit and the driving circuit are disposed in each pixel unit, so as to reduce the production costs.

Apparently, the skilled in the field can make various modifications and variations to embodiments of the present disclosure without departing from the spirit and scope of the present disclosure, the modifications and variations fall within the scope of the present disclosure.

This application claims priority to the Chinese patent application No. 201610006055.2, filed on Jan. 5, 2016, the entire disclosure of which is incorporated herein by reference as part of the present application.

What is claimed is:

1. A pixel circuit, comprising:

a plurality of driving circuits which are in one-to-one correspondence to a plurality of data lines, wherein each driving circuit is disposed in a peripheral area of a display panel where one terminal of a corresponding data line is directed to, a plurality of compensating circuits which are in one-to-one correspondence to a plurality of gate lines, wherein each compensating circuit is disposed in a peripheral area of the display panel where one terminal of a corresponding gate line is directed to, and a plurality of light emitting devices, wherein each compensating circuit comprises:

a first switching transistor, wherein a gate electrode of the first switching transistor configured to receive a first control signal, a source electrode of the first switching transistor configured to receives a first reference signal, and a drain electrode of the first switching transistor is connected to a first input terminal of a corresponding driving circuit of the driving circuits which corresponds to the compensating circuit, a second switching transistor, wherein a gate electrode of the second switching transistor configured to receives a second control signal, a source electrode of the second switching transistor configured to receives the first reference signal, and a drain electrode of the second switching transistor is connected to the first input terminal of the corresponding driving circuit, a third switching transistor, wherein a gate electrode of the third switching transistor configured to receives the first control signal, and a drain electrode of the third switching transistor is connected to the first input terminal of the corresponding driving circuit, and a fourth switching transistor, wherein a gate electrode of the fourth switching transistor configured to receives the second control signal, a source electrode of the fourth switching transistor configured to receives a second reference signal, and a drain electrode of the fourth switching transistor is connected to the source electrode of the third switching transistor.

2. The pixel circuit according to claim 1, wherein each compensating circuit comprises:

a first input terminal, configured to receive the first reference signal, a second input terminal, configured to receive the second reference signal, a first control terminal, configured to receive the first control signal, a second control terminal, configured to receive the second control signal, and an output terminal, connected to the first input terminal of the corresponding driving circuit of the driving circuits which corresponds to the compensating circuit, wherein under a control of the first control signal and the second control signal, the compensating circuit outputs the first reference signal or the second reference signal to the first input terminal of the corresponding driving circuit.

3. The pixel circuit according to claim 1, wherein, each driving circuit comprises:

a first input terminal, connected to an output terminal of a corresponding compensating circuit of the compensating circuits which corresponds to the driving circuit, a second input terminal, configured to receive a data signal from a corresponding data line, a third control terminal, configured to receive a third control signal, a fourth control terminal, configured to receive a fourth control signal, and an output terminal, connected to an input terminal of a corresponding light emitting device of the light emitting devices which corresponds to the driving circuit, wherein, under a control of the third control signal and the fourth control signal, the driving circuit drives the corresponding light emitting device to emit light through a signal from the corresponding compensating circuit and the data signal from the corresponding data line.

4. The pixel circuit according to claim 1, wherein, each light emitting device comprises:

an input terminal connected to an output terminal of one of the driving circuits which corresponds to the light emitting device, and an output terminal connected to a third reference signal terminal.

5. The pixel circuit according to claim 1, wherein, each compensating circuit outputs a gate scanning signal to the corresponding gate line.

6. The pixel circuit according to claim 1, wherein, each driving circuit comprises:

a writing sub-circuit, comprising a first control terminal configured to receive a third control signal, a second control terminal configured to receive a fourth control signal, a first input terminal configured to receive a data signal from a corresponding data line, an output terminal connected to a first node and a second input terminal connected to a second node, wherein under a control of the third control signal and the fourth control signal, the writing sub-circuit is configured to write the data signal from the corresponding data line to the first node, and implement threshold voltage compensation to the first node, a driving sub-circuit, comprising a control terminal connected to the first node, an input terminal connected to an output terminal of a corresponding compensating circuit of the compensating circuits which corresponds to the driving circuit and an output terminal connected to the second node, wherein under a control of the first node, the driving sub-circuit outputs a signal from the corresponding compensating circuit to the second node, and a light-emitting control sub-circuit, comprising a control terminal configured to receive the third control signal, an input terminal connected to the second node and an output terminal connected to an input terminal of a corresponding light emitting device of the light emitting devices which corresponds to the driving circuit, wherein under a control of the third control signal, the light-emitting control sub-circuit outputs a signal of the second node to the input terminal of the corresponding light emitting device.

7. The pixel circuit according to claim 6, wherein, the writing sub-circuit comprises:

a data writing sub-circuit, comprising a control terminal configured to receive the third control signal, an input terminal configured to receive a data signal from the corresponding data line and an output terminal connected to the first node, wherein under the control of the third control signal, the data writing sub-circuit writes the data signal from the corresponding data line to the first node, and a compensating sub-circuit, comprising a control terminal configured to receive the fourth control signal, an input terminal connected to the second node and an output terminal connected to the first node, wherein under a control of the fourth control signal, the compensating sub-circuit is configured to electrically conduct the first node and the second node and implement threshold voltage compensation to the first node.

8. The pixel circuit according to claim 7, wherein, the data writing sub-circuit comprises:

a fifth switching transistor, wherein a gate electrode of the fifth switching transistor receives the third control signal, and a source electrode of the fifth switching transistor receives the data signal from the corresponding data line, and a capacitor, wherein one terminal of the capacitor is connected to a drain electrode of the fifth switching transistor, and the other terminal of the capacitor is connected to the first node.

9. The pixel circuit according to claim 7, wherein, the compensating sub-circuit comprises:

a sixth switching transistor, wherein a gate electrode of the sixth switching transistor receives the fourth control signal, a source electrode of the sixth switching transistor is connected to the second node, and a drain electrode of the sixth switching transistor is connected to the first node.

10. The pixel circuit according to claim 6, wherein, the driving sub-circuit comprises:

a seventh switching transistor, wherein a gate electrode of the seventh switching transistor is connected to the first node, a source electrode of the seventh switching transistor is connected to the output terminal of the corresponding compensating circuit, and a drain electrode of the seventh switching transistor is connected to the second node.

11. The pixel circuit according to claim 6, wherein, the light-emitting control sub-circuit comprises:

an eighth switching transistor, wherein a gate electrode of the eighth switching transistor receives the third control signal, a source electrode of the eighth switching transistor is connected to the second node, and a drain electrode of the eighth switching transistor is connected to the input terminal of the corresponding light emitting device.

12. A display panel, comprising:

the pixel circuit according to claim 1, a gate electrode driver configured to provide the first control signal and the second control signal to a first control terminal and a second control terminal of each compensating circuit of the pixel circuit respectively, wherein, under a control of the first control signal and the second control signal, each compensating circuit is configured to output the first reference signal or the second reference signal to the first input terminal of the corresponding driving circuit which corresponds to the compensating circuit in the pixel circuit, and a source electrode driver configured to provide a data signal to each driving circuit in the pixel circuit, wherein, each driving circuit is configured to drive a light emitting device corresponding to the driving circuit in the pixel circuit to emit light through a signal from the compensating circuit which corresponds to the driving circuit in the pixel circuit and the data signal from the source electrode driver.

13. The display panel according to claim 12, wherein, the gate electrode driver is configured to output a gate scanning signal to a corresponding gate line through the compensating circuit.

14. A display device, comprising the display panel according to claim 12.

15. The pixel circuit according to claim 2, wherein, each driving circuit comprises:

a first input terminal, connected to an output terminal of a corresponding compensating circuit of the compensating circuits which corresponds to the driving circuit, a second input terminal, configured to receive a data signal from a corresponding data line, a third control terminal, configured to receive a third control signal, a fourth control terminal, configured to receive a fourth control signal, and an output terminal, connected to an input terminal of a corresponding light emitting device of the light emitting devices which corresponds to the driving circuit, wherein, under a control of the third control signal and the fourth control signal, the driving circuit drives the corresponding light emitting device to emit light through a signal from the corresponding compensating circuit and the data signal from the corresponding data line.

16. The pixel circuit according to claim 15, wherein, each light emitting device comprises:

an input terminal connected to an output terminal of one of the driving circuits which corresponds to the light emitting device, and an output terminal connected to a third reference signal terminal.

17. The pixel circuit according to claim 2, wherein, each driving circuit comprises:

a writing sub-circuit, comprising a first control terminal configured to receive a third control signal, a second control terminal configured to receive a fourth control signal, a first input terminal configured to receive a data signal from a corresponding data line, an output terminal connected to a first node and a second input terminal connected to a second node, wherein under a control of the third control signal and the fourth control signal, the writing sub-circuit is configured to write the data signal from the corresponding data line to the first node, and implement threshold voltage compensation to the first node, a driving sub-circuit, comprising a control terminal connected to the first node, an input terminal connected to an output terminal of a corresponding compensating circuit of the compensating circuits which corresponds to the driving circuit and an output terminal connected to the second node, wherein under a control of the first node, the driving sub-circuit outputs a signal from the corresponding compensating circuit to the second node, and a light-emitting control sub-circuit, comprising a control terminal configured to receive the third control signal, an input terminal connected to the second node and an output terminal connected to an input terminal of a corresponding light emitting device of the light emitting devices which corresponds to the driving circuit, wherein under a control of the third control signal, the light-emitting control sub-circuit outputs a signal of the second node to the input terminal of the corresponding light emitting device.

18. The pixel circuit according to claim 17, wherein, the writing sub-circuit comprises:

a data writing sub-circuit, comprising a control terminal configured to receive the third control signal, an input terminal configured to receive a data signal from the corresponding data line and an output terminal connected to the first node, wherein under the control of the third control signal, the data writing sub-circuit writes the data signal from the corresponding data line to the first node, and a compensating sub-circuit, comprising a control terminal configured to receive the fourth control signal, an input terminal connected to the second node and an output terminal connected to the first node, wherein under a control of the fourth control signal, the compensating sub-circuit is configured to electrically conduct the first node and the second node and implement threshold voltage compensation to the first node.

19. A pixel circuit, comprising:

a plurality of driving circuits which are in one-to-one correspondence to a plurality of data lines, wherein each driving circuit is disposed in a peripheral area of a display panel where one terminal of a corresponding data line is directed to, a plurality of compensating circuits which are in one-to-one correspondence to a plurality of gate lines, wherein each compensating circuit is disposed in a peripheral area of the display panel where one terminal of a corresponding gate line is directed to, and a plurality of light emitting devices, wherein each driving circuit comprises:

a writing sub-circuit, comprising a first control terminal configured to receive a third control signal, a second control terminal configured to receive a fourth control signal, a first input terminal configured to receive a data signal from a corresponding data line, an output terminal connected to a first node and a second input terminal connected to a second node, wherein under a control of the third control signal and the fourth control signal, the writing sub-circuit is configured to write the data signal from the corresponding data line to the first node, and implement threshold voltage compensation to the first node, a driving sub-circuit, comprising a control terminal connected to the first node, an input terminal connected to an output terminal of a corresponding compensating circuit of the compensating circuits which corresponds to the driving circuit and an output terminal connected to the second node, wherein under a control of the first node, the driving sub-circuit outputs a signal from the corresponding compensating circuit to the second node, and a light-emitting control sub-circuit, comprising a control terminal configured to receive the third control signal, an input terminal connected to the second node and an output terminal connected to an input terminal of a corresponding light emitting device of the light emitting devices which corresponds to the driving circuit, wherein under a control of the third control signal, the light-emitting control sub-circuit outputs a signal of the second node to the input terminal of the corresponding light emitting device.

20. A pixel circuit, comprising:

a plurality of driving circuits which are in one-to-one correspondence to a plurality of data lines, wherein each driving circuit is disposed in a peripheral area of a display panel where one terminal of a corresponding data line is directed to, a plurality of compensating circuits which are in one-to-one correspondence to a plurality of gate lines, wherein each compensating circuit is disposed in a peripheral area of the display panel where one terminal of a corresponding gate line is directed to, and a plurality of light emitting devices, wherein each driving circuit comprises:

a writing sub-circuit, comprising a first control terminal configured to receive a third control signal, a second control terminal configured to receive a fourth control signal, a first input terminal configured to receive a data signal from a corresponding data line, an output terminal connected to a first node and a second input terminal connected to a second node, wherein under a control of the third control signal and the fourth control signal, the writing sub-circuit is configured to write the data signal from the corresponding data line to the first node, and implement threshold voltage compensation to the first node, a driving sub-circuit, comprising a control terminal connected to the first node, an input terminal connected to an output terminal of a corresponding compensating circuit of the compensating circuits which corresponds to the driving circuit and an output terminal connected to the second node, wherein under a control of the first node, the driving sub-circuit outputs a signal from the corresponding compensating circuit to the second node, and a light-emitting control sub-circuit, comprising a control terminal configured to receive the third control signal, an input terminal connected to the second node and an output terminal connected to an input terminal of a corresponding light emitting device of the light emitting devices which corresponds to the driving circuit, wherein under a control of the third control signal, the light-emitting control sub-circuit outputs a signal of the second node to the input terminal of the corresponding light emitting device, wherein the writing sub-circuit comprises:

a data writing sub-circuit, comprising a control terminal configured to receive the third control signal, an input terminal configured to receive a data signal from the corresponding data line and an output terminal connected to the first node, wherein under the control of the third control signal, the data writing sub-circuit writes the data signal from the corresponding data line to the first node, and a compensating sub-circuit, comprising a control terminal configured to receive the fourth control signal, an input terminal connected to the second node and an output terminal connected to the first node, wherein under a control of the fourth control signal, the compensating sub-circuit is configured to electrically conduct the first node and the second node and implement threshold voltage compensation to the first node.

* * * * *